US005855806A

United States Patent [19]

Caltrider

[11] Patent Number: 5,855,806

[45] Date of Patent: Jan. 5, 1999

[54] WINDOW POUR MOLD

[75] Inventor: Larry John Caltrider, Des Moines, Iowa

[73] Assignee: M & G Manufacturing Company Incorporated, Adel, Iowa

[21] Appl. No.: 834,052

[22] Filed: Apr. 11, 1997

Related U.S. Application Data

[60] Provisional application No. 60/022,033 Jul. 22, 1996.

[51] Int. Cl.[6] ..... E04G 15/02

[52] U.S. Cl. ..... 249/39; 249/91

[58] Field of Search ..... 249/39, 91; 52/204.55

[56] References Cited

U.S. PATENT DOCUMENTS

| | | | |
|---|---|---|---|
| 1,483,851 | 2/1924 | Perry | 52/204.55 |
| 1,501,568 | 1/1913 | Emtman | 249/39 |
| 2,162,601 | 6/1939 | Bayley | 52/204.55 |
| 2,166,870 | 7/1939 | Livesay | 52/204.55 |
| 2,272,310 | 2/1942 | Peirson | 52/204.55 |
| 2,557,631 | 6/1951 | Callan | 249/96 |
| 2,602,983 | 7/1952 | Troiel | 249/95 |
| 2,658,252 | 11/1953 | Avril | 249/39 |
| 2,683,913 | 7/1954 | Honnigford | 249/178 |
| 2,787,820 | 4/1957 | Shields et al. | 249/19 |
| 2,901,810 | 9/1959 | Richards | 249/39 |
| 3,439,894 | 4/1969 | Haider | 249/39 |
| 3,517,906 | 6/1970 | Blonde | 249/184 |
| 3,689,021 | 9/1972 | Liester | 249/113 |
| 3,994,470 | 11/1976 | Nakada | 249/93 |
| 4,047,691 | 9/1977 | Wolf | 249/97 |
| 4,138,084 | 2/1979 | Reid | 249/83 |
| 4,159,098 | 6/1979 | Wong | 249/61 |
| 4,159,099 | 6/1979 | Maguire | 249/93 |
| 4,430,831 | 2/1984 | Kemp | 52/211 |
| 4,589,624 | 5/1986 | Jones | 249/39 |
| 4,625,940 | 12/1986 | Barton | 249/83 |
| 4,666,388 | 5/1987 | Kovasna et al. | 425/62 |
| 4,690,368 | 9/1987 | Heiman | 249/37 |
| 5,169,544 | 12/1992 | Stanfill et al. | 249/22 |
| 5,440,847 | 8/1995 | Butler | 52/311.1 |

FOREIGN PATENT DOCUMENTS

| | | | |
|---|---|---|---|
| 2579251 | 9/1986 | France | 249/39 |
| 2327225 | 12/1974 | Germany | 249/39 |
| 977650 | 11/1982 | U.S.S.R. | 249/39 |

*Primary Examiner*—Robert Davis
*Attorney, Agent, or Firm*—Robert A. Seemann

[57] ABSTRACT

A window pour mold has an outer wall mounted against a front wall and a back wall of a wall mold for a concrete wall. The outer wall has a top that extends from the front wall horizontally for a short length and obliquely downward on a curve for a longer length.

15 Claims, 13 Drawing Sheets

WINDOW POUR MOLD

This application claims benefit of U.S. Provisional Application No. 60/022,033, filed Jul. 22, 1996 and now abandoned.

BACKGROUND OF THE INVENTION

1. Field of the Invention

This invention pertains to forms for use in casting concrete walls, and more particularly to a removable casting frame or window pour mold for forming a window opening through a concrete wall such as a basement wall, for receiving a window, wherein the window can be installed by its frame or a flange on the frame, sealingly in the wall without need for a window sub-frame precast in the concrete.

2. Description of the Prior Art

FIG. 1 is a cross section partial schematic view of a PRIOR ART window pour mold.

FIG. 2 is a cross section partial schematic view of the PRIOR ART window pour mold of FIG. 1. Cross hatch is omitted for clarity.

FIG. 3 is a cross section partial schematic view of the PRIOR ART wall opening formed by the window pour mold of FIG. 1.

In FIG. 1, PRIOR ART window pour mold 100 is mounted to wooden wall mold 102 that is used to cast a basement wall so that when the concrete is poured, a concrete wall is created with the window pour mold set in the concrete wall. Window pour mold 100 is attached to wall mold 102 by nails 106 which extend through metal mounting brackets 110 into the wood.

When the window pour mold is removed from the hardened or set concrete wall, it leaves behind wall opening 126 in concrete wall 130. Outer wall 120 of pour mold 100 establishes the final shape of inner wall 124 of wall opening 126.

Outer wall 120 is a one piece aluminum extrusion having a fixed shape for a predetermined wall thickness. Outer wall 120 extends around all four sides, top, bottom, left and right, of window pour mold 100. For clarity of description, only the top side is shown. Step 136 forms step 138 on inner wall 124 for seating a window sealing flange so that the window is set into opening 126 almost midway between front face 140 and back face 142 of concrete wall 130, where front face 140 is the outside of the building and back face 142 is the face on the inner room side of the building.

Referring to FIGS. 2, and 3, PRIOR ART pour mold 100 is withdrawn 132 from opening 126. During removal, friction between the concrete inner wall 124 and the window pour mold outer wall 120 extends almost the length 128 of opening 126, because the mass of the fluid concrete presses on outer wall 120 from all four sides, top, bottom, left and right, so that the pour mold springs in slightly. When the concrete hardens it grips the outer walls of the pour mold.

Friction is especially high for window mounting area 162 which includes the space in which main frame 164 of window assembly 160 locates at one end of the window mounting area and its distance from back face 142. The friction also extends along back leg 144 length 146, 146*a*, and most of front leg 148 length 150, 150*a*.

In FIG. 3, window assembly 160 is installed in PRIOR ART opening 126 through concrete wall 130. It is set back by distances 166 and 168 respectively from front and back face 140 and 142 of wall 130. The ratio of distance 166 to 168 in prior art constructions ranges from 0.75 to 1.5.

Rain water 170 with dirt washes down face 140, and moves along under inner wall 124 PRIOR ART shape formed by PRIOR ART pour mold 100, and down over window glass 174 as shown by direction arrow 176. From inside a room of the building, an upward angle 172 view must be taken from a very low 178 vantage point 180 compared to level view 184 vantage point 186.

SUMMARY OF THE INVENTION

It is one object of the present invention to provide a window pour mold which is easy to remove from set concrete.

It is another object that friction of removing the window pour mold from a concrete wall is low.

It is another object that the window opening formed by the window pour mold directs dirt and water away from the window.

It is another object that the opening in the wall provided by the window pour mold provides a wide view through the opening from the room side of the wall, from a position close to an edge of the opening.

It is another object that the window pour mold having the above features is adaptable to fit one of a plurality of wall thicknesses.

It is another object that the window pour mold casts a step in the concrete so that a window can be installed in the concrete wall directly by the frame or a flange of the window attached to the concrete, without need for precasting a sub-frame in the concrete for receiving the window.

It is another object that concrete fasteners attached to the window pour mold before the concrete is poured remain embedded in the concrete when the window pour mold is removed from the concrete wall. The fasteners being available for attaching the window flange to the concrete wall.

It is another object that the fastener is embedded adjacent to the step in the concrete wall so that the window can be attached to the concrete wall by one flange, and can be sealed to the step by another flange of the window.

Other objects and advantages will become apparent to one reading the ensuing description of the invention.

A window pour mold has an outer wall mounted against a front wall and a back wall of a wall mold for a concrete wall. The outer wall has a top that extends from the front wall horizontally for a short length and obliquely downward on a curve for a longer length.

In another arrangement of the invention, a window pour mold has a front, a back, an outer wall adapted for forming an opening through a concrete wall for installation of a window in the opening. The outer wall surrounds an axis through the front and the back of the window pour mold. The top of the outer wall adjacent to the front of the outer wall includes a curve that curves outward from the axis toward the front of the outer wall. The front of the top of the outer wall is parallel to the axis and is a continuation of the curve. The curve extends in a tangent of the curve to a first planar section of the outer wall angled toward the axis and the back of the outer wall.

The curve and the first planar section are formed on an extrusion. The fronts each of at least three sides of the top, bottom, left side and right side of the outer wall include the extrusion.

The first planar section extends to a first wall that extends laterally to the axis, and a second planar section is attached to the first wall, angled toward the axis and extends to the back of the outer wall.

BRIEF DESCRIPTION OF THE DRAWINGS

In order that the invention be more fully comprehended, it will now be described, by way of example, with reference to the accompanying schematic view drawings, in which.

DESCRIPTION OF THE PREFERRED EMBODIMENTS

Figure 1:
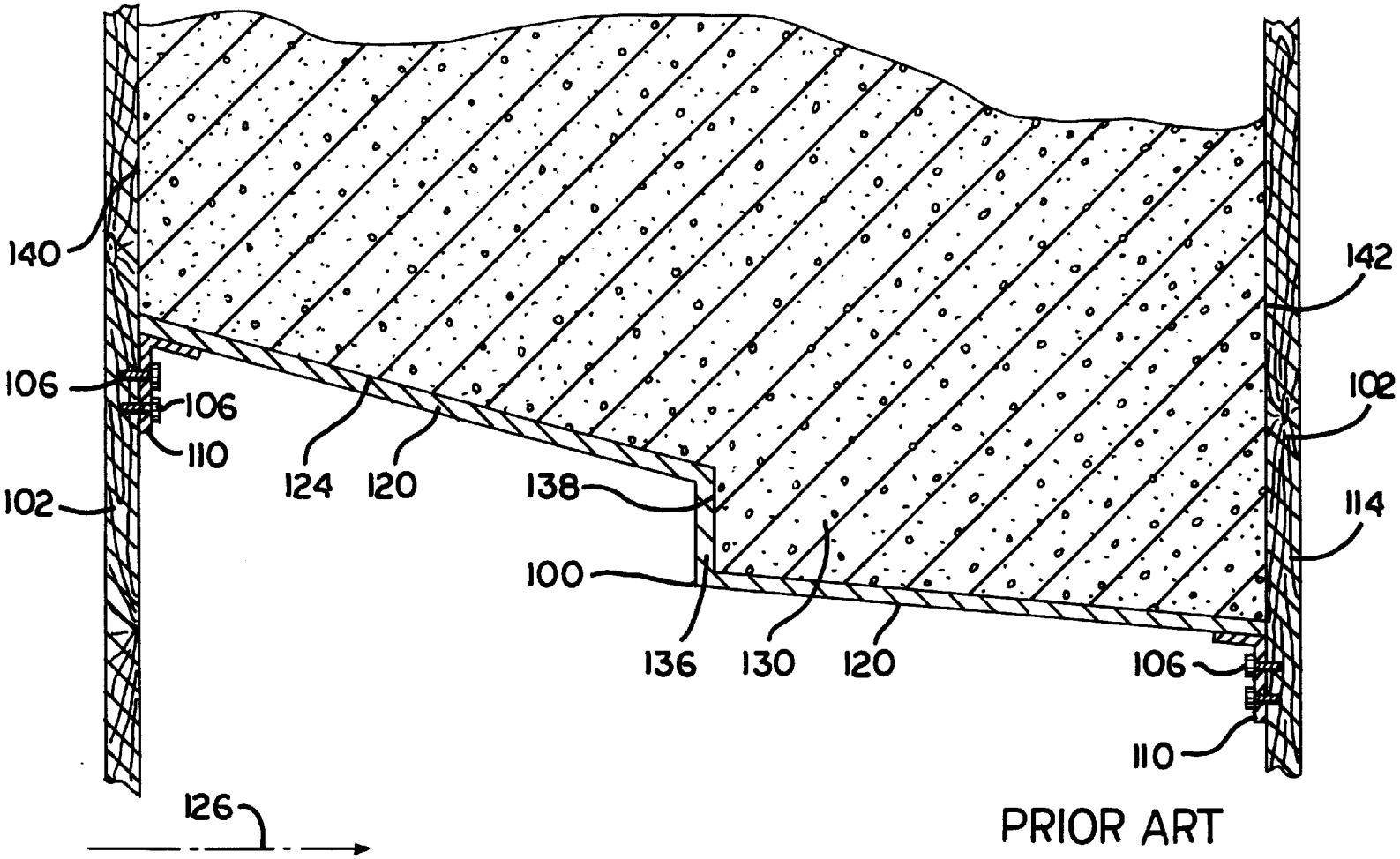
PRIOR ART FIG. 1
Figure 2:
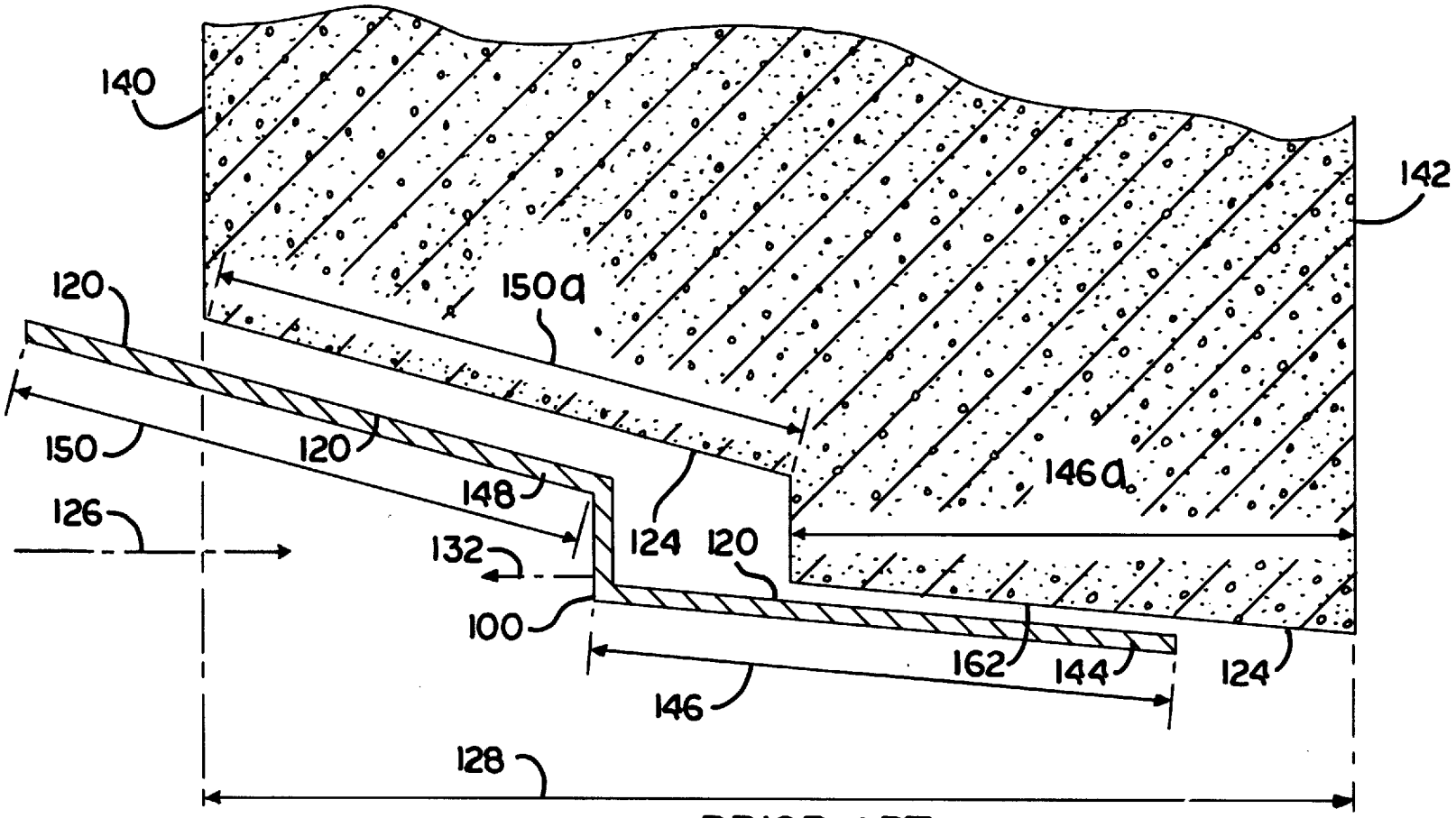
PRIOR ART FIG. 2
Figure 3:
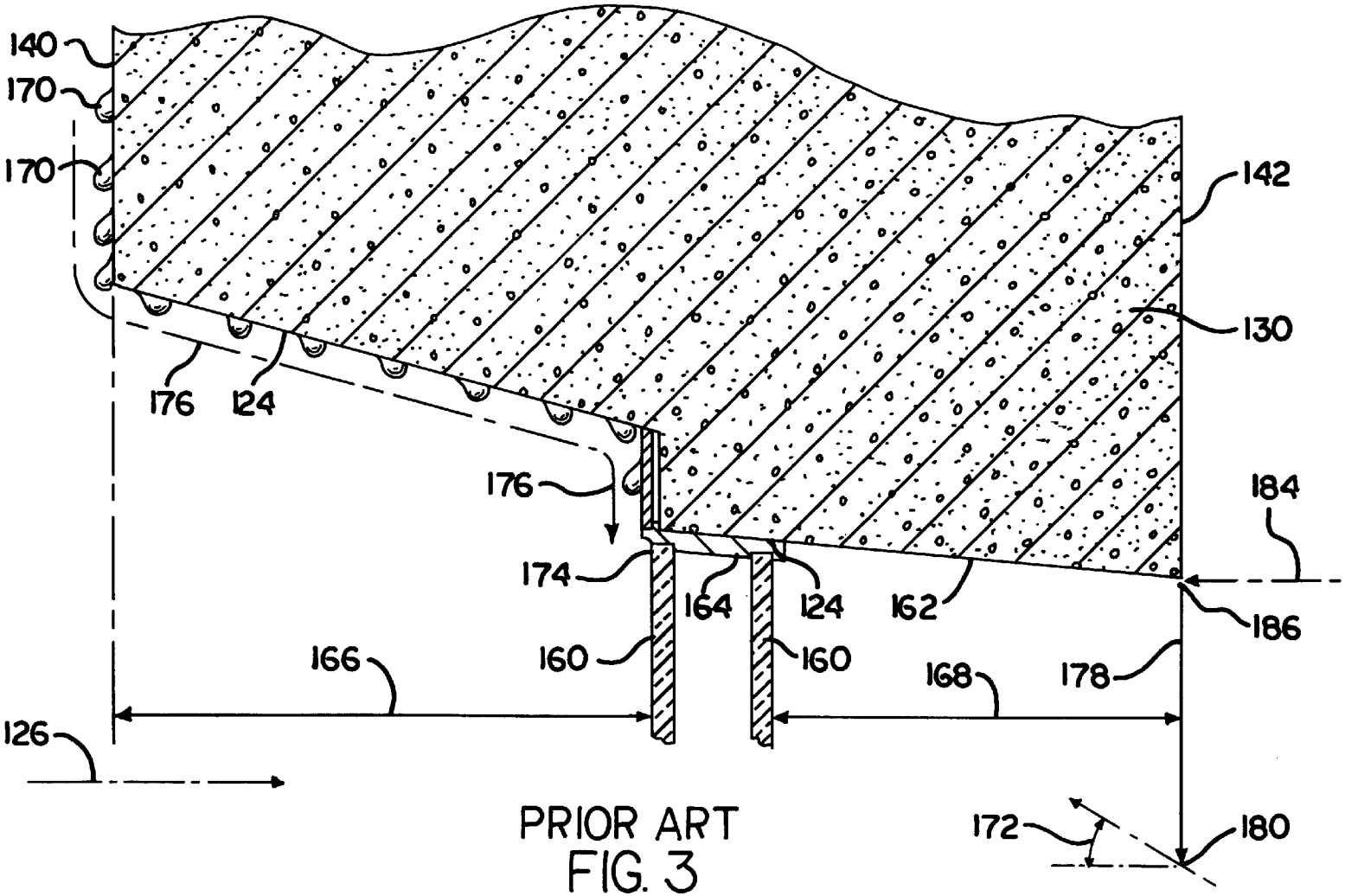
PRIOR ART FIG. 3

Before explaining the invention in detail, it is to be understood that the invention is not limited in its application to the detail of construction and arrangement of parts illustrated in the drawings since the invention is capable of other embodiments and of being practiced or carried out in various ways. Dimensions are given by way of example of construction and not of limitation of the invention.

Figure 4:
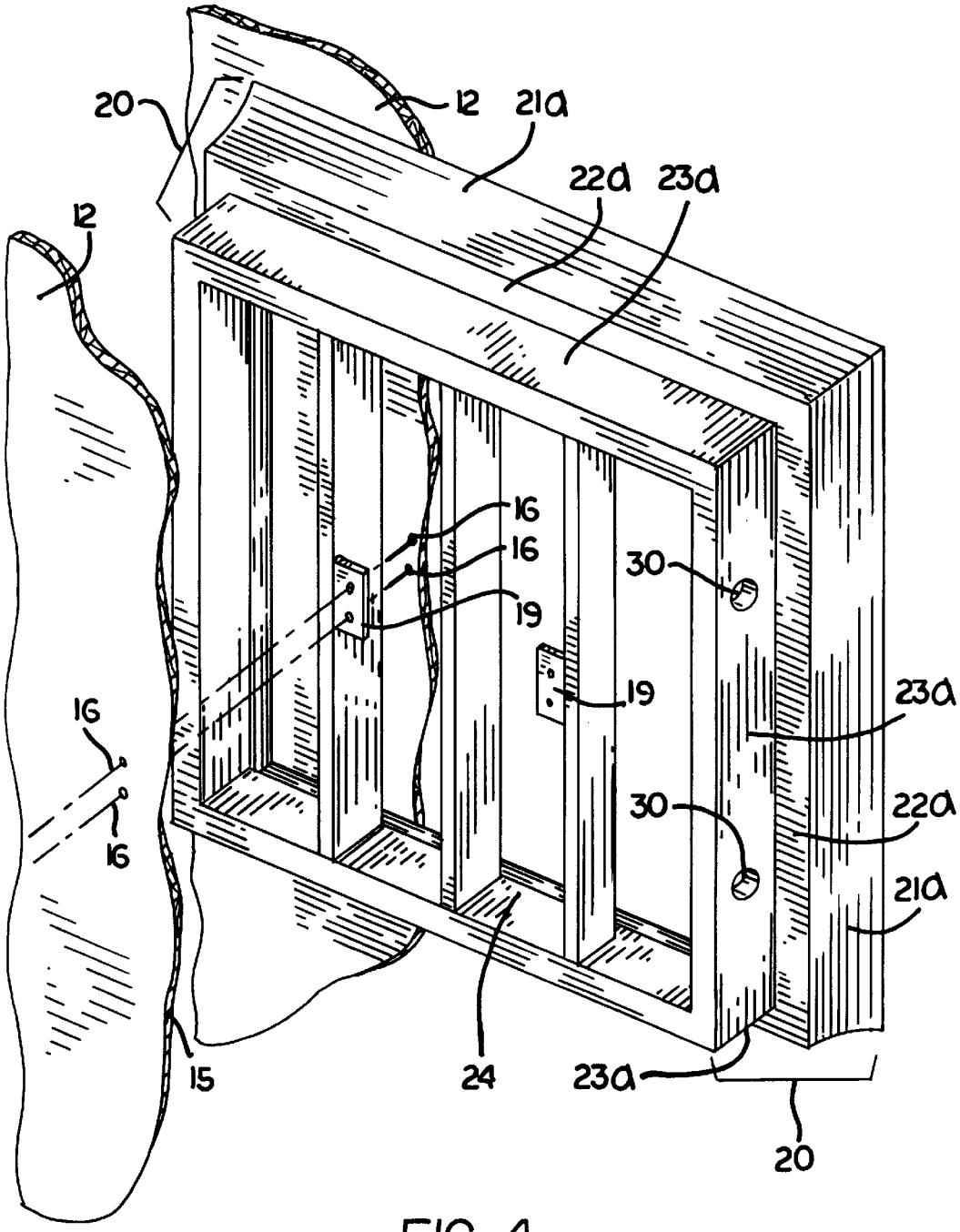
FIG. 4 is a perspective back view of a window pour mold of the invention.
Figure 5:
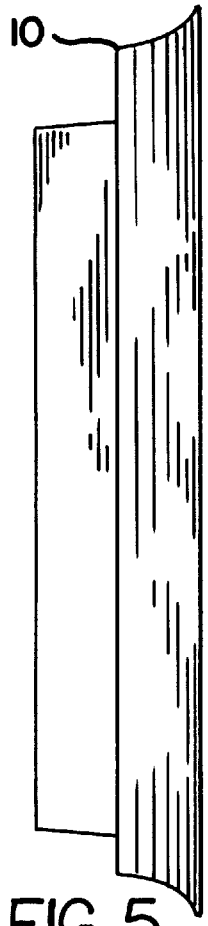
FIG. 5 is a side view of the window pour mold of FIG. 4.
Figure 6:
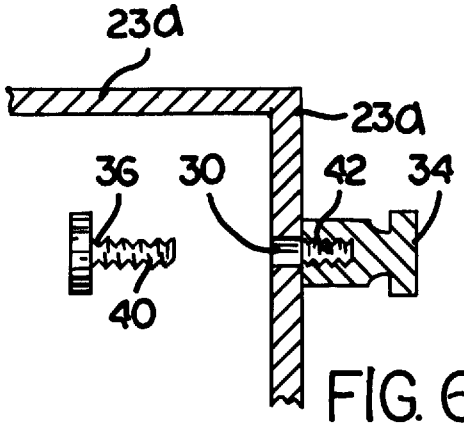
FIG. 6 is a back view of a portion of the window pour mold of FIG. 4 with a fastener.

In FIG. 4, window pour mold 10 is attached to a wall mold 12 that is used to cast a basement wall so that when the concrete is poured, a concrete wall is created with the window pour mold set in the concrete wall. Window pour mold 10 can be attached to wall mold 12 which is usually made of wood 15, by nails 16 through mounting plates 19, or may be attached to mold 12 by other means.

Figure 10:
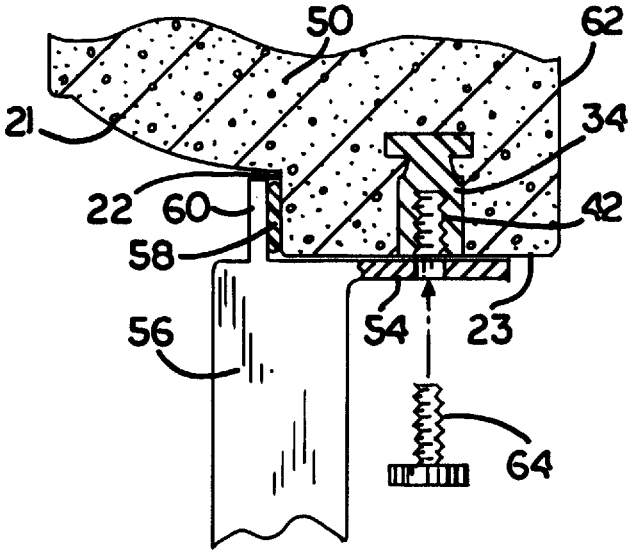
FIG. 10 is a top view of a side portion of a window frame mounted to a concrete wall of an opening cast in the wall by the window pour mold of FIG. 4. The fastener cast in the wall is shown in cross section.
Figure 11:
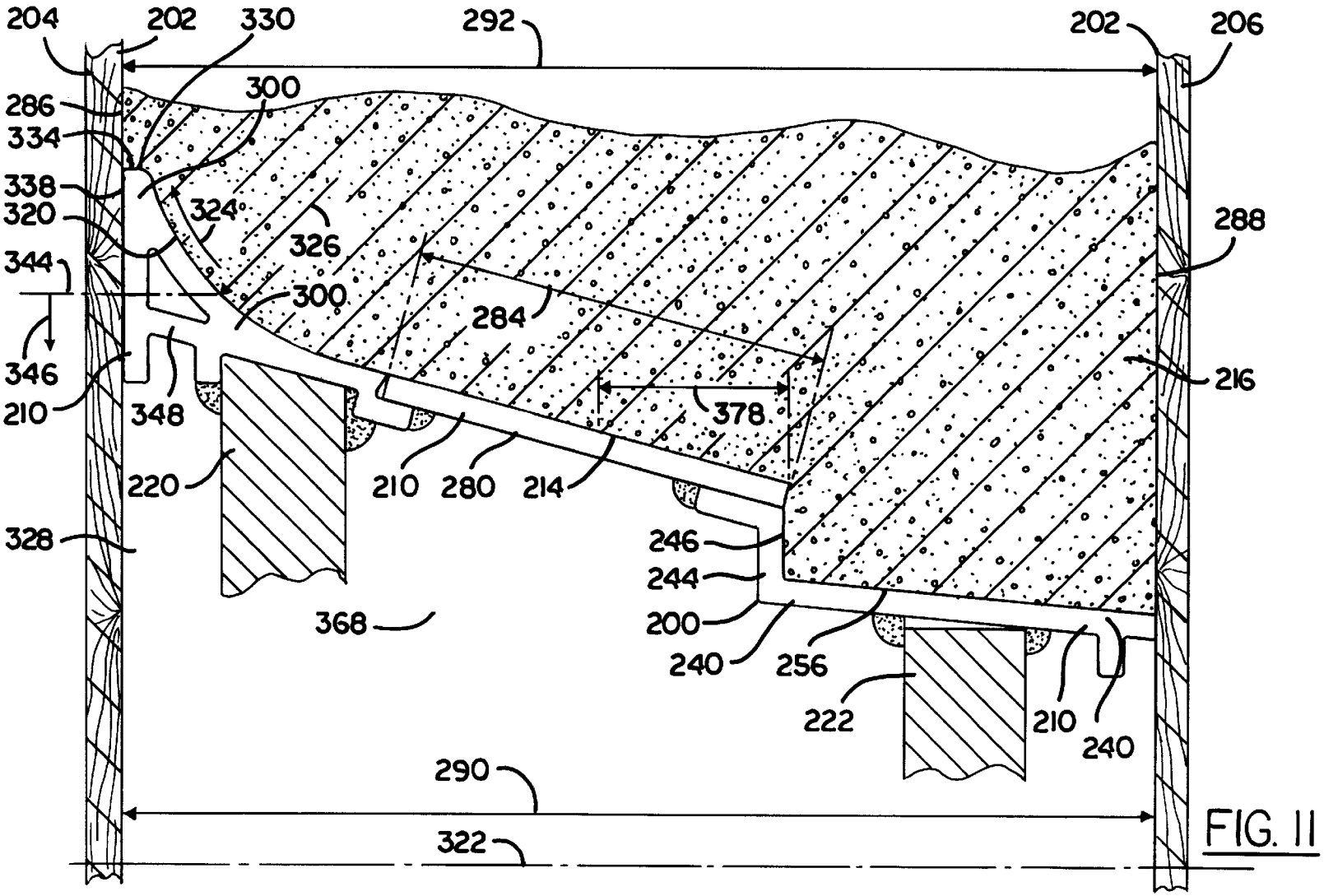
FIG. 11 is a cross section partial view of a window pour mold of the invention. Cross hatch is omitted for clarity.
Figure 12:
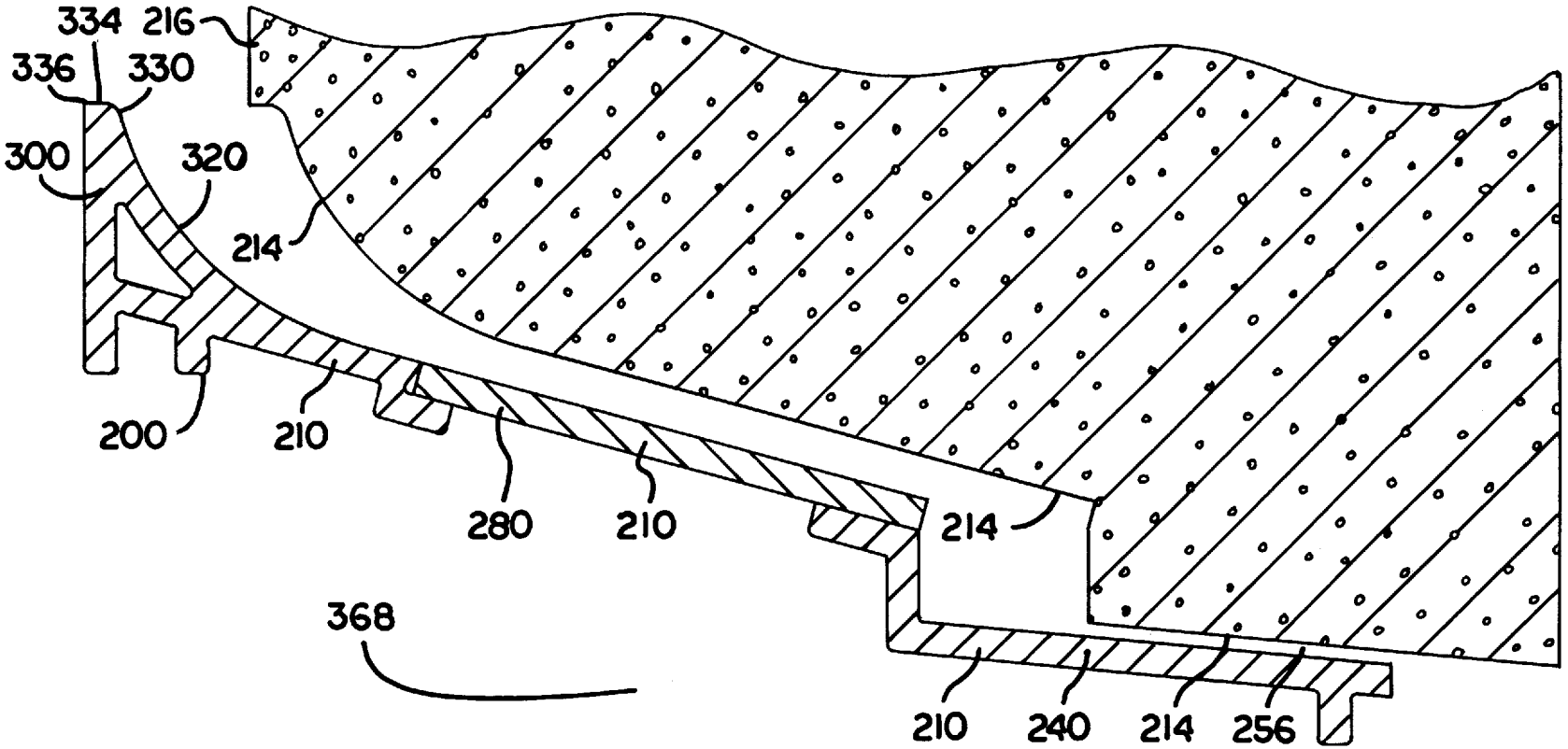
FIG. 12 is a cross section partial view of the window pour mold of FIG. 11.
Figure 13:
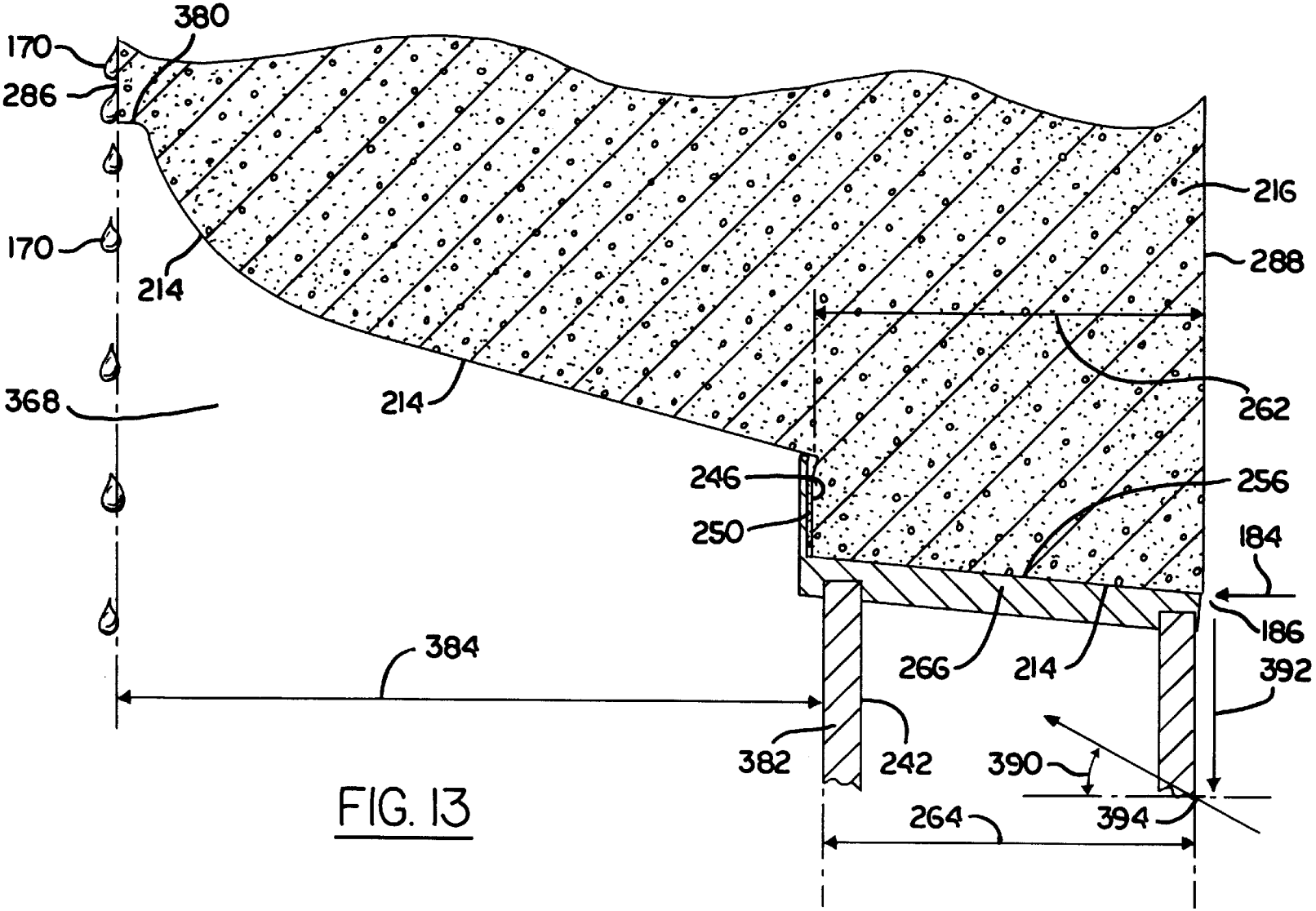
FIG. 13 is a cross section partial view of the wall opening formed by the window pour mold of FIG. 11.
Figure 15:
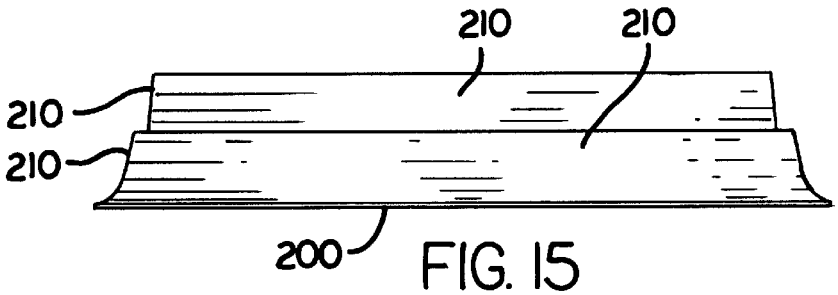
FIG. 15 is a top view of the window pour mold of FIG. 14.
Figure 14:
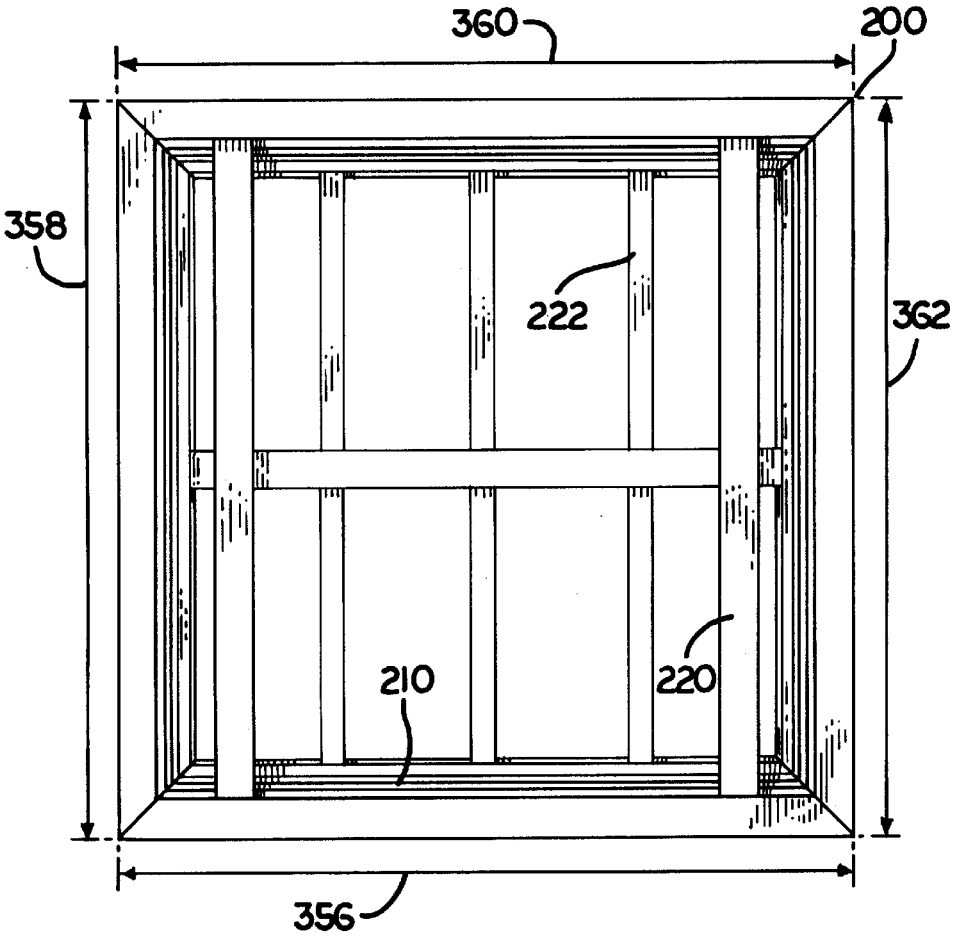
FIG. 14 is a front view of the window pour mold of FIG. 11.
Figure 16:
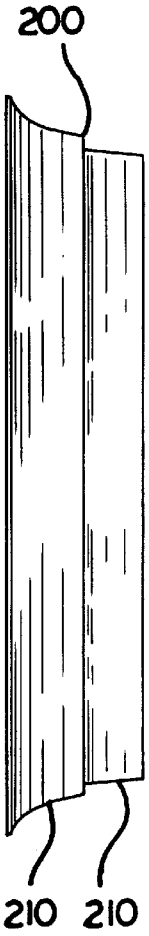
FIG. 16 is a side view of the window pour mold of FIG. 14.

Outer walls 20 surround the inside 24 of window pour mold 10. When the window pour mold is removed from the hardened or set concrete wall, it leaves behind a hole through the wall which has the shape of outer walls 20 of window pour mold 10. This is seen in FIG. 10 where curved wall 21, forward facing step 22, and inward facing straight wall 23 of concrete wall 62 are formed by outward curved wall 21*a,* rearward facing step 22*a,* and outward and upward facing side of straight wall 23*a* of mold 10.

Figure 9:
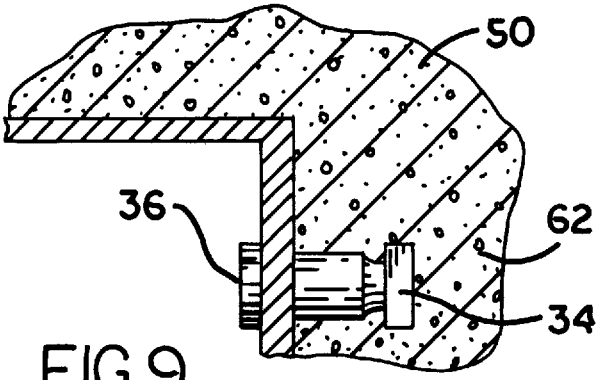
FIG. 9 is a back view of the portion of FIG. 6 with the concrete fastener attached and embedded in concrete. The concrete is shown in cross section.
Figure 7:
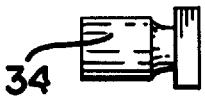
FIG. 7 is a back view of a concrete fastener.
Figure 8:
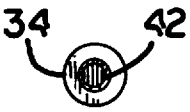
FIG. 8 is a right side view of the concrete fastener.

Holes 30 are for attaching concrete fastener 34 by bolt 36 to wall 23*a* by threads 40 and 42. A series of fasteners 34 are attached to wall 23*a* before window pour mold 10 is cast in the concrete wall so that the fasteners become embedded in the concrete 50, as shown in FIGS. 9 and 10.

After casting and the concrete is set, bolts 36 and nails 16 are removed, and window pour mold 10 is removed from concrete wall 62.

A different fastener may be used which has a head that shears off when the window pour mold is drawn out of the set concrete wall. This eliminates use of a bolt to attach the fastener to wall 23*a* and need to unscrew the bolt in order to be able to remove the window pour mold from the set concrete wall.

Fasteners other than nails may be used to attach the window pour mold to the wall mold.

A window 56 can then be attached to concrete wall 62 by bolting 64 the window through the frame of the window or through flanges such as flanges 54, to the fasteners 34 which are in the concrete wall, with sealing material 58 between flanges 60 and the concrete wall. Flanges 60 extend around the perimeter of the window for a complete seal between the window and the concrete wall.

Referring to FIGS. 11, 12, 13, 14, 15, and 16, window pour mold 200 is mounted between wall mold 202 front wall 204 and back wall 206. Outer wall 210 of window pour mold 200 forms inner wall 214 of concrete wall 216. Front face 338 is against wall 204 and horizontal top 334 of front leg 330 extends to wall 204. Back leg 240 extends to wall 206. Wall 210 is supported against the crushing inward force of the fluid concrete by support columns 220, 222 which extend to outer wall 210 on an opposite side of pour mold 200. Back leg 240 provides step 244 to form step 246 for the window assembly 242 seal 250, and window mounting area 256 for the window main frame 266 installation.

Outer wall 210 surrounds axis 322 which passes through the inside 328 of window pour mold 200.

Trim leg 280 length 284 is selected to match the overall length 290 of wall 210 to front 286 to back 288 length 292 of concrete wall 216.

Front leg 300 has curve 320 which turns facing outward from axis 322 inside 328 of window pour mold 200, on radius 326. The radius of curve 320 is outside of wall 210. Wall 210 is between axis 322 and the origin of radius 326.

Curve 320 joins curve 330 which turns facing downward to horizontal or level face 334 that extends to front face 338.

It should be understood that edge 336 may be broken or rounded off according to good engineering practices, but not so much as to cause the concrete to cast in front of front face 338 and prevent withdrawal of window pour mold 200 from the hardened concrete. Horizontal face 334 may be as short front to back as a horizontal tangent of curve 330. Preferably it is less than the length of radius 326 of curve 320.

Preferably front leg 300 face 338 extends inward of 346 the center 344 of the arc of curve 320, and is supported by wall 348. Preferably front leg 300 is an extrusion which provides wall 348 support along widths 356, 358, 360, and 362 of the window pour mold.

Pour mold outer wall 210 extends to each end of front 286 and back 288 of wall 216 within a combined total of ⅛".

Front leg 300 is preferably an aluminum extrusion having a single stock size and shape that is used for all concrete wall lengths 292 from six inches to 12 inches in normal installations, and for special other installations.

Back leg 240 is preferably an aluminum extrusion having a single stock size and shape that is used for all concrete wall lengths from six inches to 12 inches in normal installations and for special other installations.

Trim leg 280 is preferably a sheared aluminum plate having a predetermined length for each of a plurality of lengths of 292, for example according to the following chart:

| 292 length | 284 length |
|---|---|
| 7-½" | 1.667" |
| 8" | 2.119" |
| 9" | 3.154" |
| 9-½" | 3.737" |
| 10" | 4.190" |
| 11" | 5.225" |
| 12" | 7.295" |

Trim leg 280 can be made in other lengths for special installations of other than the above sizes.

The front leg, back leg, and trim leg of outer wall 210 are bonded together, preferably by braze or weld.

Window pour mold 200 outer wall 210 provides about a 25% reduction in frictional forces that resist withdrawal of the window pour mold from opening 368 formed in concrete wall 216 by mold 200, compared to PRIOR ART.

With respect to friction in the window mounting area 256 for retaining the main frame of the window, the high-friction causing component is the back leg. Back leg 240 is much shorter than prior art leg 144 so that the high-friction causing component is small in the present invention. Trim leg 280 occupies portion 378 of the length 292 that would be occupied by the PRIOR ART back leg 144, but trim leg 280 is angled more steeply upward or outward from inside 328, in the 378 length portion than prior art leg 144 is angled in that portion, so that friction of withdrawal is less in the 378 portion for the invention than it is for the PRIOR ART which is level or only slightly tilted and affected by friction at the start up of withdrawal.

Friction of withdrawal along curve 330 of front leg 300 is negligible at start up of withdrawal. Friction at horizontal 334 extends over less than one half inch.

Rain water moves down past level portion 380 formed on the concrete wall by level or horizontal portion 334 of front leg 300 of the window pour mold, and falls past opening 368 below front 286 of wall 216, instead of running inward of opening 368 over inner wall 214, to window pane 382.

Window pane 382 and seal 250 are further inward of opening 368 from front 286, and are well and better protected from weather by distance 384 under inner wall 214 than distance 166 of PRIOR ART under inner wall 124.

Window assembly 242 occupies nearly all of window mounting area 256 and is about flush with back 288 of the concrete wall. From inside a room of the building, an upward angle 390 view can be taken from a relatively high or close to the wall 392 vantage point 394 compared to level view 184 vantage point 186 because window mounting area 256 formed by back leg 240 has a short length 262 which is also close to the length 264 of the window assembly.

Figure 17:
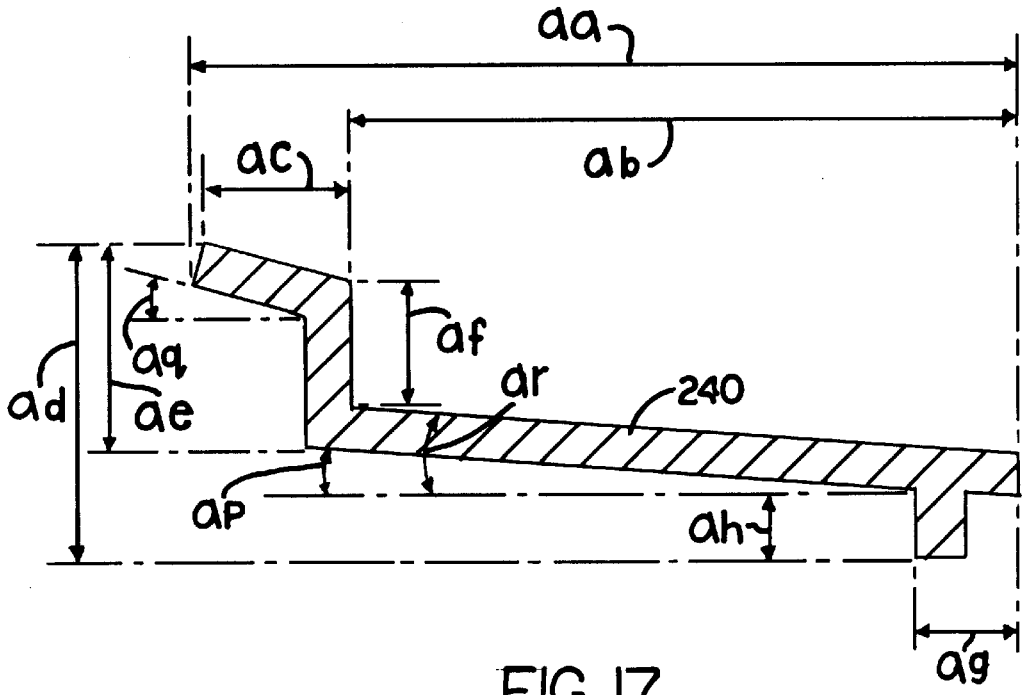
FIG. 17 is a cross section view of an element of the window pour mold of FIG. 11.

Regarding FIG. 17, Preferred dimensions of a stock back leg 240 of window pour mold 200 follow.

In inches; aa 3.512 ab 2.839 ac 0.625 ad 1.516 ae 0.882 af 0.545 ag 0.252 ah 0.316 and in degrees;

ap 3–7 aq 15 ar 3–7

Figure 18:
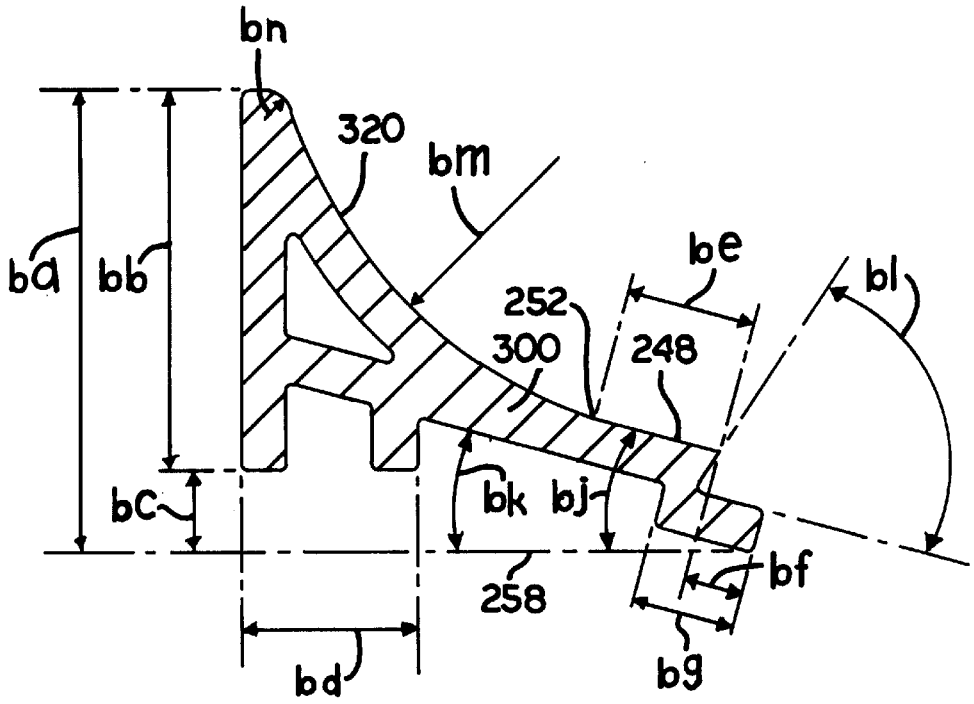
FIG. 18 is a cross section view of an element of the window pour mold of FIG. 11.

Regarding FIG. 18, Preferred dimensions of a stock front leg 300 of window pour mold 200 follow.

In inches;

ba 1.971 bb 1.625 bc 0.346 bd 0.750 be 0.549 bf 0.253 bg 0.440 bf 0.253 in degrees;

bj 12–17 bk 12–17 bl 72 radius in inches;

bm 1.7–2.3 bn 0.125

Radius bm extends in a tangent 252 of the curve 320 to planar section 248 which is angled upward or outward 15 degrees from horizontal 258.

Figure 19:
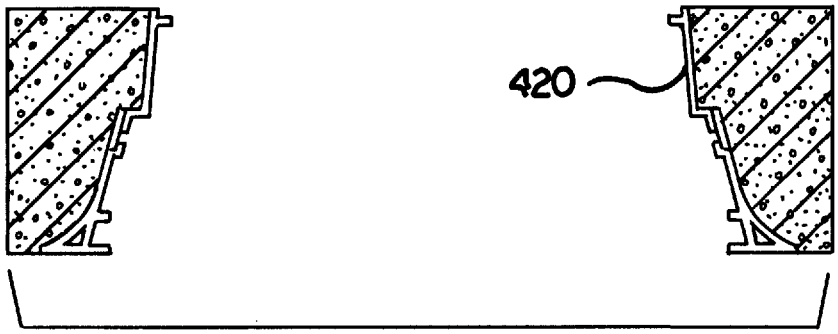
FIG. 19 is a cross section top view of a window pour mold of the invention.
Figure 20:
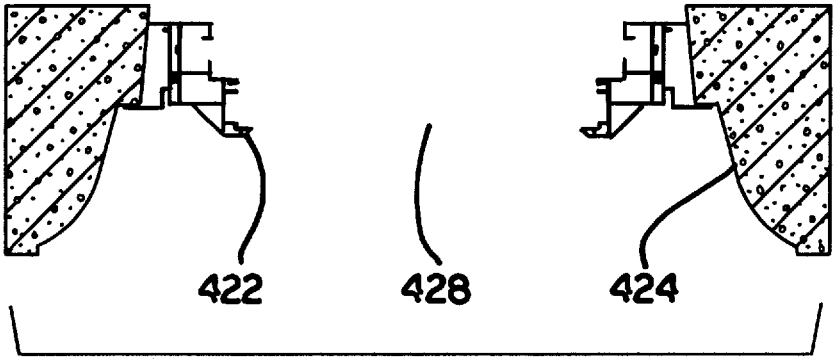
FIG. 20 is a top view of a window assembly installed in an opening made in a concrete wall by the window pour mold of FIG. 19.

Referring to FIGS. 19 and 20, window assembly 422 is mounted in the opening in concrete wall 424 formed by window pour mold 420.

Figure 21:
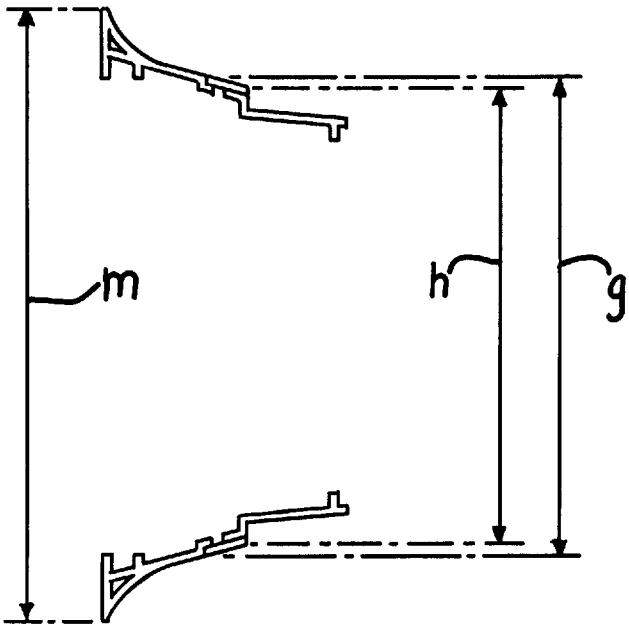
FIG. 21 is a cross section side view of a window pour mold of the invention. Cross hatch is omitted for clarity.
Figure 22:
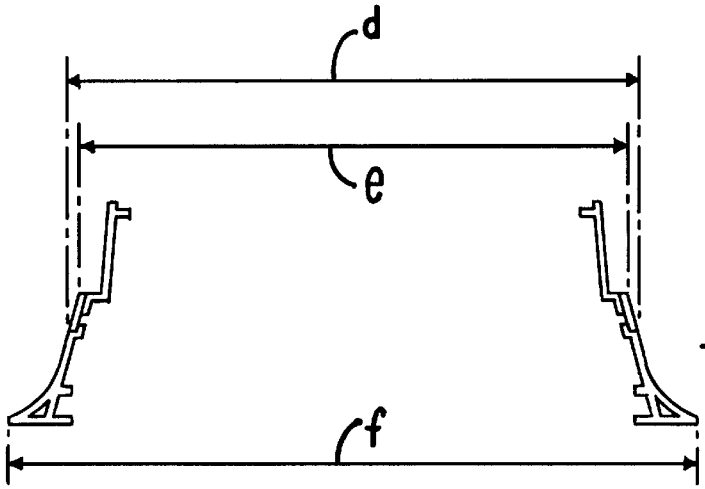
FIG. 22 is a cross section top view of the window pour mold of FIG. 21. Cross hatch is omitted for clarity.
Figure 23:
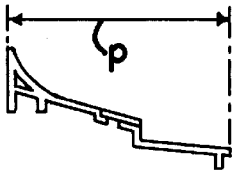
FIG. 23 is a cross section side view of elements of the window pour mold of FIG. 21. Cross hatch is omitted for clarity.

Regarding FIGS. 21, 22, and 23 preferred dimensions of various window pour molds for different thickness concrete walls are shown below.

| Wall | d | e | f | g | h | m | p |
|---|---|---|---|---|---|---|---|
| 6" | 33.094 | 32.484 | 36.186 | 14.344 | 13.734 | 17.436 | 5.875 |
| 7" | 33.630 | 32.484 | 36.722 | 14.880 | 13.734 | 17.972 | 6.875 |
| 7.5" | 33.931 | 32.484 | 37.024 | 15.181 | 13.734 | 18.274 | 7.437 |
| 8" | 34.166 | 32.484 | 37.258 | 15.416 | 13.712 | 18.508 | 7.875 |
| 9" | 34.702 | | 37.794 | 15.952 | | 19.044 | 8.875 |
| 10" | | 35.238 | 38.330 | 16.488 | | 19.580 | 9.875 |
| 12" | 36.310 | | 39.402 | 17.560 | | 20.652 | 11.875 |

Figure 25:
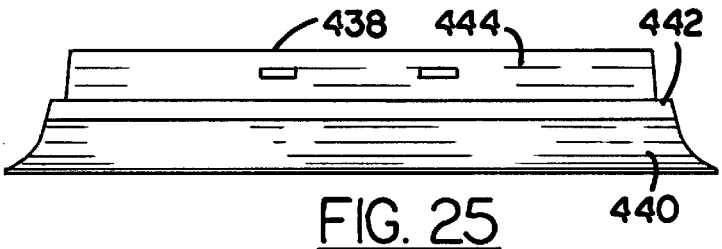
FIG. 25 is a top view of the window pour mold of FIG. 24.
Figure 24:
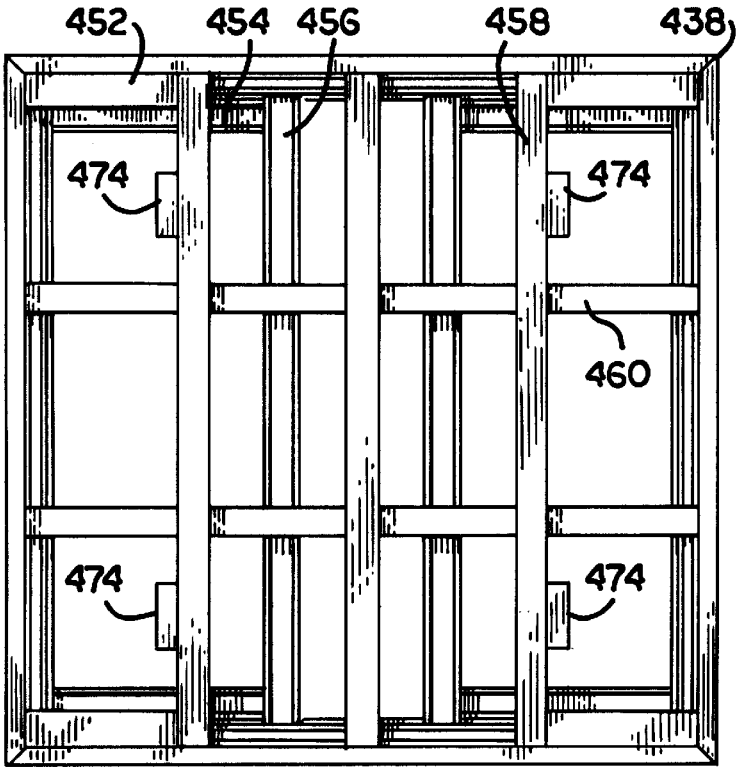
FIG. 24 is a front view of a window pour mold of the invention.
Figure 26:
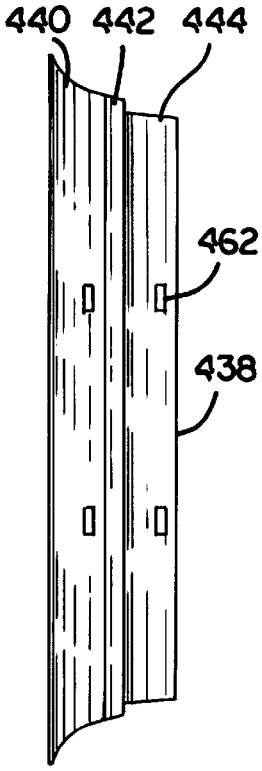
FIG. 26 is a side view of the window pour mold of FIG. 24.

In FIGS. 24, 25, and 26, window pour mold 438 includes front leg 440, trim leg 442, back leg 444, and uses eight of front leg horizontal support 452, four of back leg horizontal support 454, two of back leg vertical support 456, three of front leg vertical support 458, two of front leg horizontal brace 460, and two of back leg horizontal brace 462.

The window pour mold may be attached to a wall mold by nails through positioning brackets 474 which extend from vertical supports 458, or may be attached to the wall mold by other means.

Figure 29:
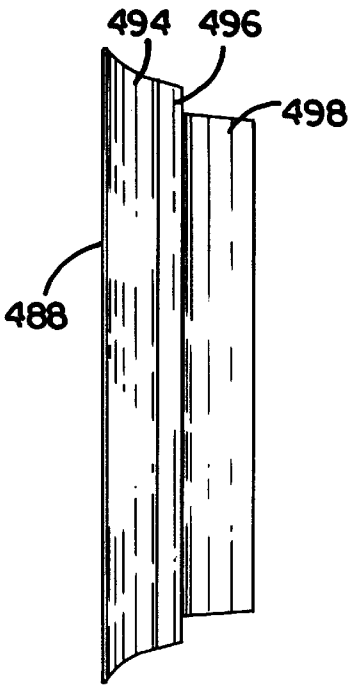
FIG. 29 is a side view of the window pour mold of FIG. 27.
Figure 28:
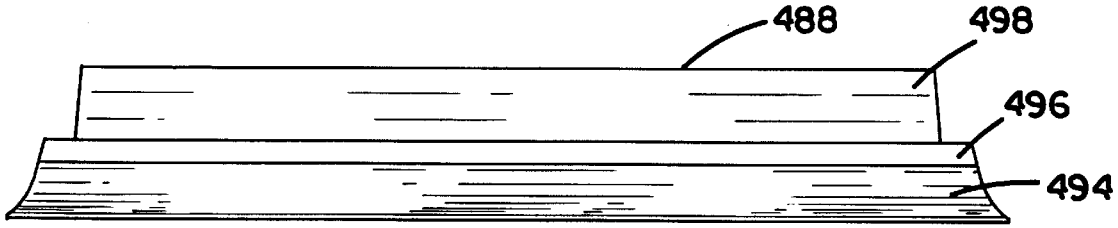
FIG. 28 is a top view of the window pour mold of FIG. 27.
Figure 27:
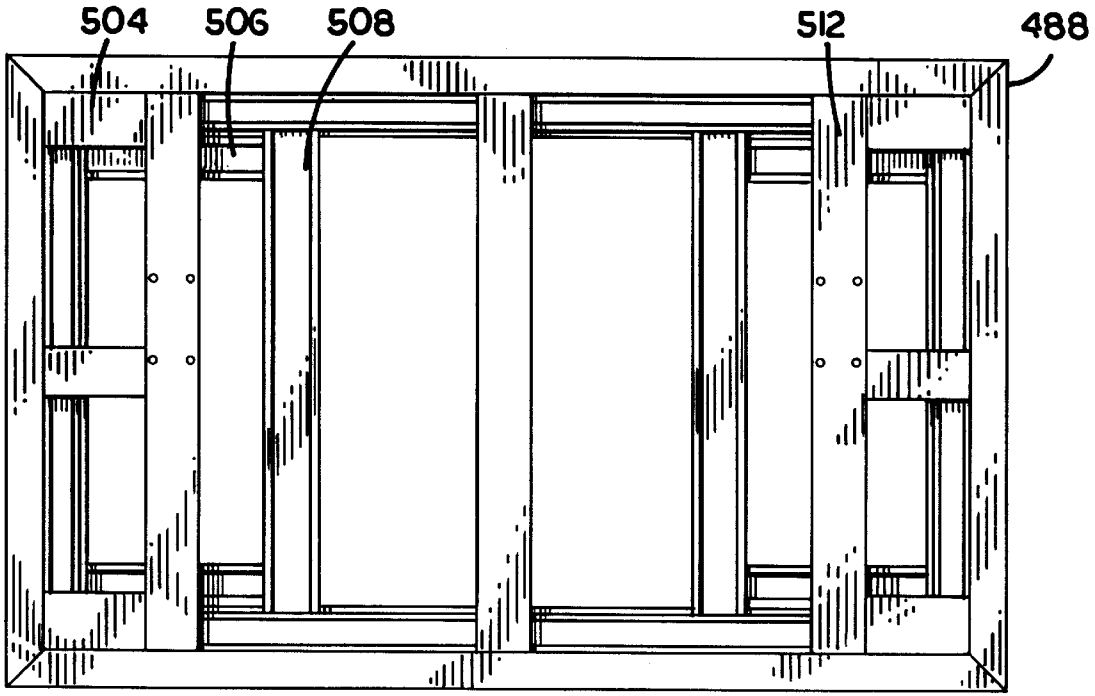
FIG. 27 is a front view of a window pour mold of the invention.

In FIGS. 27, 28, and 29, window pour mold 488 includes front leg 494, trim leg 496, and back leg 498, and uses six front leg horizontal supports 504, four back leg horizontal supports 506, two back leg vertical supports 508, and three front leg vertical supports 512.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. A window pour mold having a front, a top, a back and an outer wall adapted for forming an opening through a concrete wall for installation of a window in the opening, said outer wall surrounding an axis through the front and back of the window pour mold and having a front, a back, a top, a bottom, a left side and a right side, the top of said outer wall at the top of said window pour mold adjacent to the front of said outer wall comprising a first curve that curves outward from said axis toward the front of said outer wall, the front of the top of said outer wall being parallel to said axis, and the front of said outer wall being a continuation of said first curve.

2. A window pour mold having a front, a top, a back and an outer wall adapted for forming an opening through a concrete wall for installation of a window in the opening, said outer wall surrounding an axis through the front and back of the window pour mold and having a front, a back, a top, a bottom, a left side and a right side, the top of said outer wall at the top of said window pour mold adjacent to the front of said outer wall comprising a first curve that curves outward from said axis toward the front of said outer wall, said first curve extending tangent to a first planar section of said outer wall.

3. A window pour mold having a front, a top, a back and an outer wall adapted for forming an opening through a concrete wall for installation of a window in the opening, said outer wall surrounding an axis through the front and back of the window pour mold and having a front, a back, a top, a bottom, a left side and a right side, the top of said outer wall at the top of said window pour mold adjacent to the front of said outer wall comprising a first curve that curves outward from said axis toward the front of said outer wall, said first curve extending in a tangent of said first curve to a first planar section of said outer wall angled toward said axis and the back of said outer wall.

4. The window pour mold of claim 3, wherein said first curve and the first planar section tangent to said first curve are formed on an extrusion.

5. The window pour mold of claim 1 wherein said first curve is formed on an extrusion, the front of at least one of the bottom, left side and right side of said outer wall comprising the extrusion.

6. The window pour mold of claim 3 wherein said first planar section is at an angle in the range of 12 degrees to 17 degrees to the axis.

7. The window pour mold of claim 3 further comprising said first planar section extending to a first wall that extends laterally to said axis, and a second planar section attached to said first wall and angled toward said axis.

8. The window pour mold of claim 7 wherein said second planar section extends to the back of said outer wall.

9. The window pour mold of claim 8 wherein said second planar section is at an angle in the range of 3 degrees to 7 degrees to the axis.

10. The window pour mold of claim 7 further comprising a third planar section between said first planar section and said first wall, permanently attached to said first planar section and to said first wall.

11. In a window pour mold having the top outer wall of said window pour mold mounted against a first vertical wall and a second vertical wall of a wall mold for a concrete wall, the improvement comprising the top surface of said top outer wall of said window pour mold comprising a front adjacent to said first wall extending from said first wall horizontally for a length, turning obliquely downward for a length so that the downward facing side of the top of an opening in a concrete wall formed by said window pour mold comprises the front of the downward facing side extending back horizontally for a length, turning obliquely downward for a length.

12. In a window pour mold having the top outer wall of said window pour mold mounted against a first wall and a second wall of a wall mold for a concrete wall, the improvement comprising said top outer wall comprising a front adjacent to said first wall extending from said first wall horizontally for a short length, turning obliquely downward on a curve extending away from said first wall.

13. A window pour mold having a front, a back and an outer wall adapted for forming an opening through a concrete wall for installation of a window in the opening, the top of said outer wall at the top of said window pour mold adjacent to the front of said outer wall comprising a first curve that curves upward toward the front of said outer wall, the front of said top of said outer wall being horizontal, said front of said outer wall being a continuation of said first curve.

14. A window pour mold having a front, a back and an outer wall adapted for forming an opening through a concrete wall for installation of a window in the opening, the top of said outer wall at the top of said window pour mold adjacent to the front of said outer wall comprising a first curve that curves upward toward the front of said outer wall, the front of the top of said outer wall being configured so that the front of said top of said outer wall is horizontal when the window pour mold is mounted in a mold for a wall, said front of said outer wall being a continuation of said first curve.

15. A window pour mold having an outer wall adapted for forming an opening through a concrete wall for installation of a window in the opening, said outer wall surrounding an axis through the front and back of the window pour mold and having a front, a back, a top at the top of said window pour mold, a bottom at the bottom of said window pour mold, a left outward side and a right outward side, one of the outer wall top, bottom, left outward side and right outward side of said outer wall adjacent to the front of said outer wall comprising a first curve that curves outward from said axis toward the front of said outer wall, turning parallel to said axis. said front of said outer wall being a continuation of said first curve.

* * * * *